US007624738B2

(12) United States Patent
Manservigi et al.

(10) Patent No.: US 7,624,738 B2
(45) Date of Patent: Dec. 1, 2009

(54) PRODUCT CHANGE METHOD FOR A CIGARETTE MANUFACTURING MACHINE

(75) Inventors: Alberto Manservigi, Bologna (IT); Cristina Pareschi, Ferrara (IT)

(73) Assignee: G.D. Societa' per Azioni, Bologna (IT)

( * ) Notice: Subject to any disclaimer, the term of this patent is extended or adjusted under 35 U.S.C. 154(b) by 691 days.

(21) Appl. No.: 10/539,171

(22) PCT Filed: Dec. 15, 2003

(86) PCT No.: PCT/EP03/51004

§ 371 (c)(1),
(2), (4) Date: Jan. 4, 2006

(87) PCT Pub. No.: WO2004/054393

PCT Pub. Date: Jul. 1, 2004

(65) Prior Publication Data

US 2006/0130854 A1 Jun. 22, 2006

(30) Foreign Application Priority Data

Dec. 16, 2002 (IT) ..... BO2002A0790

(51) Int. Cl.
*A24B 7/14* (2006.01)

(52) U.S. Cl. ..... 131/108

(58) Field of Classification Search ..... 131/108, 131/32, 47, 58, 70, 77, 83.1, 84.1, 84.3, 84.4
See application file for complete search history.

(56) References Cited

U.S. PATENT DOCUMENTS

| | | | | | |
|---|---|---|---|---|---|
| 3,059,650 | A | * | 10/1962 | Gamberini | 131/66.1 |
| 4,630,618 | A | * | 12/1986 | Chard | 131/84.3 |
| 4,685,476 | A | * | 8/1987 | Hagemann et al. | 131/110 |
| 4,756,315 | A | | 7/1988 | Mattei et al. | |

FOREIGN PATENT DOCUMENTS

| | | |
|---|---|---|
| GB | 952077 | 3/1964 |
| GB | 2 088 693 | 6/1982 |

* cited by examiner

*Primary Examiner*—Kat Wyrozebski
*Assistant Examiner*—Daniel Lee
(74) *Attorney, Agent, or Firm*—Marshall, Gerstein & Borun LLP

(57) ABSTRACT

A product change method for a cigarette manufacturing machine, wherein an input hopper receives a first type of shredded tobacco from a supply header, and feeds it to at least one channel for forming, on a conveyor, a bead of tobacco, which is released onto a paper strip travelling along a forming table for forming a continuous cigarette rod; the method provides for cutting off supply of the first type of shredded tobacco to the header, emptying the header, cutting off communication between the header and the input hopper, cutting off supply of the paper strip, keeping the manufacturing machine running to form a waste stream of shredded tobacco of the first type and empty the manufacturing machine, and feeding a second type of shredded tobacco through the supply header and the input hopper to fill the manufacturing machine completely before starting up supply of the paper strip.

12 Claims, 2 Drawing Sheets

1
2
3a
3b
3c
4
5
6
7
8
9
10
11
12a
12b
12c
13a
13b
13c
14
15
16
17
18
19
20
21
22
23
24
25
26
27
28
29
31
II
II 2
14
15
16
17
18
19
20
22
23
24
25
26
27
28
29
30
31

PRODUCT CHANGE METHOD FOR A CIGARETTE MANUFACTURING MACHINE

CROSS-REFERENCE TO RELATED APPLICATION

This is the U.S. national phase application of International Application No. PCT/EP2003/051004, filed 15 Dec. 2003, which claims the benefit of Italian patent application number BO 2002A000790, filed Dec. 16, 2002.

TECHNICAL FIELD

The present invention relates to a product change method for a cigarette manufacturing machine.

BACKGROUND ART

On cigarette manufacturing machines for example of the type disclosed in GB-952077-A, U.S. Pat. No. 4,756,315-A1 or GB-2088693-A, product changes are normally made by stopping the machine and clearing the various compartments of the machine either by hand or using external suction devices.

Such operations would obviously involve relatively long machine stoppages and the use of skilled labour.

DISCLOSURE OF INVENTION

It is an object of the present invention to provide a product change method for a cigarette manufacturing machine, designed to eliminate the aforementioned drawback.

More specifically, it is an object of the present invention to provide a method of effecting a product change on a cigarette manufacturing machine substantially without stopping the machine.

According to the present invention, there is provided a product change method for a cigarette manufacturing machine, as claimed in Claim 1 and preferably in any one of the following Claims depending directly or indirectly on Claim 1.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figures 1, 2:
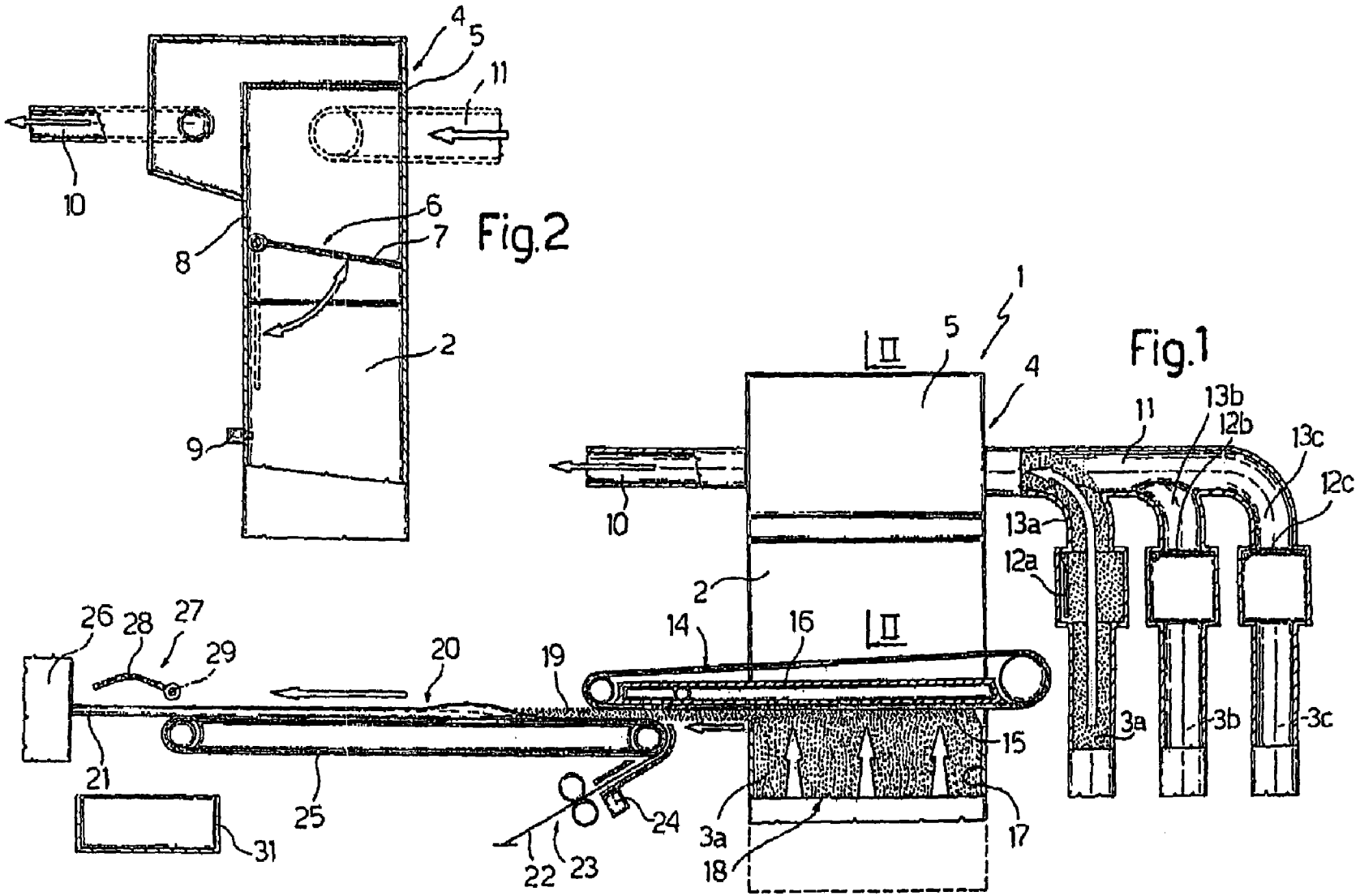
FIG. 1 shows a schematic side view, with parts in section and parts removed for clarity, of a cigarette manufacturing machine capable of operating according to the method of the present invention.
FIG. 2 shows a section along line II-II in FIG. 1.

Number 1 in FIG. 1 indicates as a whole a cigarette manufacturing machine comprising an input hopper 2 for receiving shredded tobacco 3 from a supply header 4, which in turn comprises a box 5 located on top of hopper 2 and fitted at the bottom with a shut-off valve 6 which, in the closed position, disconnects box 5 from input hopper 2. More specifically, valve 6 comprises a plate 7 hinged to a lateral wall 8 of box 5 and movable, by a known actuator (not shown) controlled by a level sensor 9 inside input hopper 2, between a vertical open position, and a horizontal closed position in which plate 7 defines a bottom wall of box 5.

Header 4 also comprises a suction conduit 10 fitted through lateral wall 8 and connected to a known suction device (not shown) for producing a vacuum in box 5; and a feed conduit 11, the outlet of which communicates with box 5 through lateral wall 8, and the inlet of which communicates selectively, by means of three valves 12*a*, 12*b*, 12*c*, with respective feed conduits 13*a*, 13*b*, 13*c* for supplying respective different types 3*a*, 3*b*, 3*c* of shredded tobacco 3.

Manufacturing machine 1 also comprises a substantially horizontal conveyor 14 having a bottom branch 15, which extends beneath a suction box 16, and an intermediate portion of which closes the top end of an upflow channel 17 for a stream 18 of shredded tobacco 3 fed (in known manner not shown) to upflow channel 17 by input hopper 2 and for forming, on bottom branch 15, a bead 19 of tobacco retained by suction on conveyor 14.

In a variation not shown, manufacturing machine 1 comprises two or more conveyors 14 fed by respective upflow channels 17 connected, in known manner, in parallel to input hopper 2.

An output end of bottom branch 15 of conveyor 14 is located over a table 20 for forming a continuous cigarette rod 21 from a paper strip 22—fed onto table 20 along a feed line 23 extending through a cutting station 24, and fed along table 20 by a conveyor 25—and from bead 19 of shredded tobacco, which is released onto paper strip 22 close to an input end of conveyor 25 and over cutting station 24. In the event a number of conveyors 14 are provided, forming table 20 is obviously connected to an equal number of feed lines 23 supplying respective paper strips 22.

As shown in FIG. 1, continuous cigarette rod 21 is fed by conveyor 25 to a known cutting device 26, for cutting continuous cigarette rod 21 transversely into portions (not shown), via an intercepting device 27 comprising a powered deflecting member 28, which rotates about an axis 29 between a raised rest position, and a lowered work position in which deflecting member 28 directs the load on conveyor 25 downwards to form a waste stream 30 which is fed into a bin 31.

Operation of manufacturing machine 1 will now be described assuming it is operating with shredded tobacco 3*a* to produce a given type of cigarette, and is to be switched over to produce a different type of cigarette from a different type of shredded tobacco, e.g. shredded tobacco 3*b*.

During the normal production run using shredded tobacco 3*a*, valve 12*a* is kept open, valves 12*b* and 12*c* are kept closed, and valve 6 is normally closed, so that the air sucked out along suction conduit 10 draws shredded tobacco 3*a* up into box 5 along feed conduit 11 to gradually fill box 5, which is only emptied into input hopper 2, by opening valve 6, when a low level of shredded tobacco inside input hopper 2 is detected by level sensor 9. That is, shredded tobacco 3*a* is transferred in bulk from box 5 to input hopper 2 under the control of level sensor 9.

Once inside input hopper 2, shredded tobacco 3*a* is transferred, in known manner not shown, to upflow channel 17, which feeds it onto the underside of bottom branch 15 of conveyor 14 to gradually form, on bottom branch 15, bead 19, which is fed by conveyor 14 onto paper strip 22 fed continuously along forming table 20 and folded gradually crosswise about bead 19 to form continuous cigarette rod 21. That is, during the normal production run, paper strip 22 is fed continuously along feed line 23 and forming table 20, receives bead 19 of tobacco 3*a* continuously, and is continuously folded crosswise to continuously form continuous cigarette rod 21, which is fed continuously beneath deflecting member 28, in the raised rest position, to cutting device 26.

Figures 3, 4, 5:
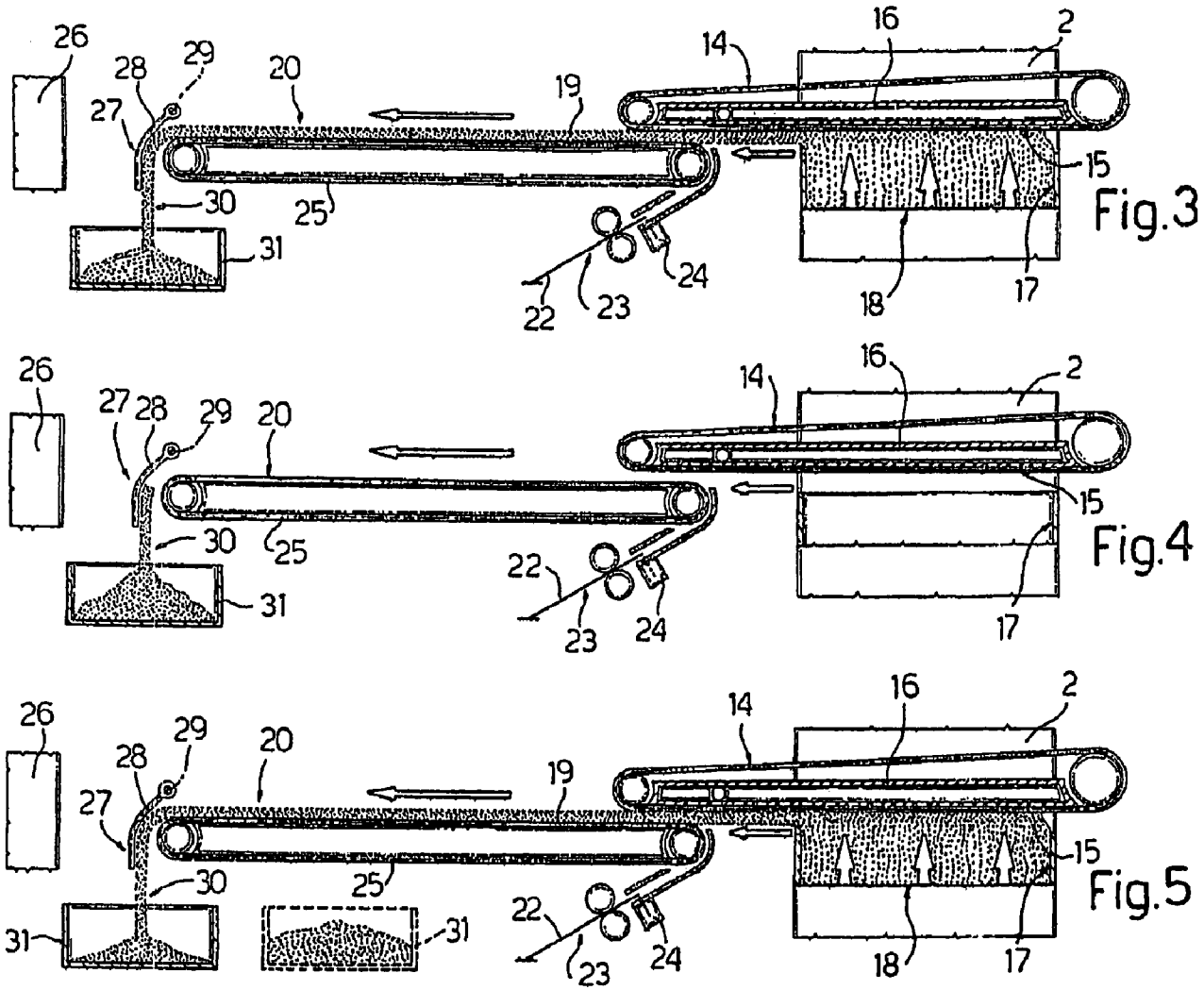
FIGS. 3, 4 and 5 show a detail of FIG. 1 in three different operating positions.

Manufacturing machine 1 is switched over to a different type of cigarette by first closing valve 12*a* to cut off supply of shredded tobacco 3*a*, stopping feed line 23, and simultaneously cutting paper strip 22 at cutting station 24 (FIG. 3), while leaving the rest of manufacturing machine 1 running, so that all the remaining shredded tobacco 3*a* is sucked into box 5, which is then opened, under the control of level sensor 9, to unload the remaining shredded tobacco 3*a* into input hopper 2 and so empty header 4 completely. At which point, suction along suction conduit 10 is cut off.

At the same time (FIG. 3), deflecting member 28 is moved into the lowered work position to direct the remaining bead 19 of shredded tobacco 3*a*, without relative paper strip 22, into waste bin 31. This operation continues (FIG. 4) until manufacturing machine 1 is cleared completely, which may optionally be perfected automatically using compressed air jets in known manner not shown.

At this point, with the machine in the same configuration described above, but with suction restored along suction conduit 10, valve 12*b* is opened to feed shredded tobacco 3*b* directly into input hopper 2 (input hopper 2 is empty to begin with, so that plate 7 is kept in the vertical open position by level sensor 9) and afterwards only into box 5. By means of successive loads of shredded tobacco 3*b*, manufacturing machine 1 is filled completely with tobacco 3*b* to form a bead 19, which is fed, without relative paper strip 22, along forming table 20 and directed by intercepting device 27 into waste bin 31. Only when the correct compactness of bead 19 of shredded tobacco 3*b* is achieved, are conveyors 14 and 25 stopped and then started again, after feeding paper strip 22 along forming table 20, to form a new type of continuous cigarette rod 21, a first portion of which is again directed by intercepting device 27 into waste bin 31. Finally, deflecting member 28 is restored to the raised rest position to permit normal production of the new type of cigarette using shredded tobacco 3*b*.

The invention claimed is:

1. A product change method for a cigarette manufacturing machine, wherein the product change includes modifying the shredded tobacco (3) fed to an input hopper (2) from an old first type (3*a*) to a new second type (3*b*), the method comprising:

feeding the first type (3*a*) of shredded tobacco to the input hopper (2) from a supply header (4), feeding the first type (3*a*) of shredded tobacco from the input hopper (2) to at least one channel (17) for forming a bead (19) of tobacco, which is released onto a paper strip (22) travelling along a forming table (20) having a conveyor (25) for forming a continuous cigarette rod (21);

cutting off supply of said first type (3*a*) of tobacco to the input hopper (2);

unloading the first type (3*a*) of shredded tobacco from the input hopper (2), channel (17) and forming table (20) by activating automatically a deflecting member (28) arranged at an output end of the forming table (20) to deflect a waste stream (30) of shredded tobacco of the first type (3*a*) into container means (31) arranged at the output end of the forming table (20) and by leaving the conveyor (25) of the forming table (20) running;

feeding, when the input hopper (2), channel (17) and forming table (20) are completely empty, the second type (3*b*) of shredded tobacco through the supply header (4), input hopper (2) and forming table (20) by leaving the conveyor (25) of the forming table (20) running;

deflecting the second type (3*b*) of shredded tobacco into the container means (31) arranged at the end of the forming table (20) by means of the deflecting member (28) until the forming table (20) is completely full; and deactivating automatically the deflecting member (28) when the regular production using the second type (3*b*) of shredded tobacco is ready to be started.

2. A method as claimed in claim 1, wherein unloading the first type (3*a*) of tobacco comprises arresting said paper strip (22).

3. A method as claimed in claim 2, and further comprising only starting up supply of said paper strip (22) when the manufacturing machine (1) is filled completely with said second type (3*b*) of shredded tobacco.

4. A method as claimed in claim 1, wherein the manufacturing machine (1) is filled completely with said second type (3*b*) of shredded tobacco in successive loads; each load being formed inside said header (4) separated from said input hopper (2), and being unloaded into said input hopper (2) by connecting said header (4) to said input hopper (2).

5. A method as claimed in claim 1, wherein the manufacturing machine (1) is filled completely with said second type (3*b*) of shredded tobacco by forming a bead (19) of the second type (3*b*) of tobacco along said forming table (20).

6. A method as claimed in claim 5, wherein said bead (19) of the second type (3*b*) of tobacco is left without the relative paper strip (22) until a given desired compactness is achieved.

7. A method as claimed in claim 6, wherein said bead (19) of the second type (3*b*) of tobacco, without the relative said paper strip (22), is deflected into container means (31).

8. A method as claimed in claim 6, wherein said paper strip (22) is fed, with the bead (19) of the second type (3*b*) of tobacco, along said forming table (20) to form a new type of continuous cigarette rod (21); an initial portion of said new type of continuous cigarette rod (21) being deflected into said container means (31).

9. A method as claimed in claim 1, wherein the supply header (4) comprises a box (5) located on top of the hopper (2) and fitted at the bottom with a shut-off valve (6) which, in the closed position, disconnects box (5) from input hopper (2).

10. A method as claimed in claim 1, wherein supply header (4) comprises:

a suction conduit (10) fitted through a lateral wall (8) of the box (5) and for producing a vacuum in the box (5); and a feed conduit (11), the outlet of which communicates with the box (5) through the lateral wall (8), and the inlet of which communicates selectively, by means of at least two valves (12*a*, 12*b*, 12*c*), with respective feed conduits (13*a*, 13*b*, 13*c*) for supplying respective different types (3*a*, 3*b*, 3*c*) of shredded tobacco (3).

11. A method as claimed in claim 10, further comprising:

keeping the shut-off valve (6) normally closed;

drawing shredded tobacco (3) up into the box (5) along the feed conduit (11) and by means of the air sucked out along the suction conduit (10) to gradually fill box (5);

detecting the level of shredded tobacco (3) inside the input hopper (2) by a level sensor (9); and opening the shut-off valve (6) when a low level of shredded tobacco (3) inside the input hopper (2) is detected by the level sensor (9) to transfer the shredded tobacco (3*a*) in bulk from the box (5) to the input hopper (3).

12. A method as claimed in claim 10, further comprising:

keeping open a first valve (12*a*) through which the first type (3*a*) of shredded tobacco is fed when the first type (3*a*) of shredded tobacco is to be supplied to the input hopper (2);

keeping closed a second valve (12*b*) through which the second type (3*b*) of shredded tobacco is fed when the first type (3*b*) of shredded tobacco is to be supplied to the input hopper (2);

keeping closed the first valve (12*a*) through which the first type (3*a*) of shredded tobacco is fed when the second type (3*b*) of shredded tobacco is to be supplied to the input hopper (2); and keeping open the second valve (12*b*) through which the second type (3*b*) of shredded tobacco is fed when the second type (3*b*) of shredded tobacco is to be supplied to the input hopper (2).

* * * * *